US008011646B2

(12) United States Patent
Choi

(10) Patent No.: US 8,011,646 B2
(45) Date of Patent: Sep. 6, 2011

(54) STRUCTURE OF VACUUM CHUCK FOR ABSORBING SUBSTRATE

(75) Inventor: Moon-Ho Choi, Daegu (KR)

(73) Assignee: LG Display Co., Ltd., Seoul (KR)

( * ) Notice: Subject to any disclaimer, the term of this patent is extended or adjusted under 35 U.S.C. 154(b) by 193 days.

(21) Appl. No.: 10/252,722

(22) Filed: Sep. 24, 2002

(65) Prior Publication Data

US 2003/0075849 A1 Apr. 24, 2003

(30) Foreign Application Priority Data

Sep. 24, 2001 (KR) ..... 2001-59086

(51) Int. Cl.
*B25B 11/00* (2006.01)

(52) U.S. Cl. ..... 269/21; 269/903; 269/289 R

(58) Field of Classification Search ..... 269/21, 269/20, 289 R, 903, 900; 279/3; 125/35; 294/64.1, 64.2, 64.3; 451/388, 412; 248/262, 248/263

See application file for complete search history.

(56) References Cited

U.S. PATENT DOCUMENTS

| | | | | |
|---|---|---|---|---|
| 2,317,348 | A * | 4/1943 | Wekeman | 248/363 |
| 2,853,333 | A * | 9/1958 | Littell | 294/64.1 |
| 2,895,706 | A * | 7/1959 | Blatherwick | 269/21 |
| 3,195,941 | A * | 7/1965 | Morey | 294/64.1 |
| 4,066,249 | A * | 1/1978 | Huber et al. | 269/21 |
| 5,457,868 | A * | 10/1995 | Blaimschein | 29/559 |
| 5,486,932 | A * | 1/1996 | Leonard | 358/498 |
| 6,439,559 | B1 * | 8/2002 | Kinnard et al. | 269/21 |
| 6,672,576 | B1 * | 1/2004 | Walker | 269/21 |
| 2003/0075849 | A1 * | 4/2003 | Choi | 269/21 |

FOREIGN PATENT DOCUMENTS

KR 2020000013180 7/2000

* cited by examiner

*Primary Examiner* — Lee D Wilson
(74) *Attorney, Agent, or Firm* — Birch, Stewart, Kolasch & Birch LLP

(57) ABSTRACT

A structure of a vacuum chuck for absorbing a substrate and usable in the fabrication of a liquid crystal display device is provided. This structure includes an absorbing plate absorbing a surface of the substrate, and a plurality of vacuum lines in an oblique line shape on the absorbing plate.

12 Claims, 9 Drawing Sheets

STRUCTURE OF VACUUM CHUCK FOR ABSORBING SUBSTRATE

The present application claims, under 35 U.S.C §119, the benefit of Korean Patent Application No. 59086/2001 filed Sep. 24, 2001, which is herein fully incorporated by reference.

BACKGROUND OF THE INVENTION

1. Field of the Invention

The present invention relates to a structure of a vacuum chuck for absorbing a substrate and particularly, to a structure of a vacuum chuck usable in an exposure device of a liquid crystal display (LCD) device, for reducing defective factors of the LCD device.

2. Description of the Related Art

Generally, an LCD device is a display device which displays an image corresponding to a data signal by individually supplying the data signal to liquid crystal cells which are aligned in a matrix form and by adjusting a light transmittance ratio of the liquid crystal cells.

The LCD device includes an LCD panel which is formed by aligning liquid crystal cells which form pixel units in the active matrix form, and an integrated circuit (IC) for driving the liquid crystal cells. The LCD panel includes upper and lower substrates and a liquid crystal layer which is formed by injecting liquid crystal in the space between the upper and lower substrates.

A common electrode and pixel electrodes are respectively formed on the inner surfaces of the upper and lower substrates. An electric field is applied to the liquid crystal layer through the common electrode and the pixel electrodes. Such pixel electrodes are formed on the lower substrate of each liquid crystal cell and on the other hand, the common electrode is integrally formed on a front surface of the upper substrate.

Also, on the lower substrate of the LCD panel, a plurality of data lines for transmitting a data signal and a plurality of gate lines for transmitting a scan signal are formed to cross each other at about 90° angles. A liquid crystal cell is formed at each crossing section of the data lines and gate lines. A gate driver IC sequentially supplies a scan signal to the plurality of gate lines so that the liquid crystal cells which are aligned in a matrix form are sequentially selected. Data signals are supplied from a data driver IC to the liquid crystal cells of the selected gate line.

The LCD device also includes thin film transistors TFTs which are used as switching devices in respective liquid crystal cells. A conductive channel is formed between the source/drain electrodes of each TFT as a scan signal is supplied to the gate electrode of the TFT through the corresponding gate line. At this time, a data signal is supplied to the source electrode of the TFT through the corresponding data line, which is then transmitted to the corresponding pixel electrode through the conductive channel and drain electrode of the TFT. By the operation of the electric field created between the pixel electrode and the common electrode, then the light transmittance ratio of the corresponding liquid crystal cell is adjusted.

FIG. 1A is a plan view showing a general liquid crystal cell of an LCD device. As shown in the drawing, the liquid crystal cell defined by the crossing of a data line 2 and a gate line 4 includes a TFT, and a pixel electrode 14 which is connected to the drain electrode 12 of the TFT. The source electrode 8 of the TFT is connected to the data line 2 and the gate electrode 10 is connected to the gate line 4.

The drain electrode 12 of the TFT is connected to the pixel electrode 14 through a drain contact hole 16. In the TFT, an active layer (not shown) is positioned for forming a conductive channel between the source electrode 8 and the drain electrode 12 as the scan signal is supplied to the gate electrode 10 through the gate line 4.

As the conductive channel is formed between the source electrode 8 and the drain electrode 12 in response to the scan signal supplied from the gate line 4, the data signal which is supplied to the source electrode 8 through the data line 2 can be transmitted to the drain electrode 12.

On the other hand, the pixel electrode 14 which is connected to the drain electrode 12 through the drain contact hole 16 is widely formed in the region where the liquid crystal is positioned in each liquid crystal cell, and it is formed with indium tin oxide (ITO) material having a high light transmittance ratio.

At this time, the pixel electrode 14 and a common electrode (not shown) generate an electric field in the liquid crystal layer as the data signal is supplied to the pixel electrode 14 from the drain electrode 12.

When the electric field is applied, the liquid crystal rotates by dielectric anisotropy and the amount of light emitted from a back light source to the upper substrate through the pixel electrode 14 is adjusted by the voltage value of the data signal.

On the other hand, a storage electrode 20 which is connected to the pixel electrode 14 through the storage contact hole 22 forms a storage capacitor 18 by being deposited on the gate line, and the storage electrode 20 and the gate line 4 are separated from each other by a gate insulation layer formed therebetween in the process of forming the TFT.

The storage capacitor 18 minimizes the voltage change of the pixel electrode by discharging a voltage which is charged while the voltage value of the data signal is supplied to the pixel electrode 14 by applying a scan signal to the gate line 4 of the next step, after charging the voltage value of the scan signal while the scan signal is applied to a previous gate line 4.

FIG. 1B is a cross-sectional view showing a TFT region taken along section line I-I' of FIG. 1A. As shown in FIG. 1B, the TFT region includes a lower substrate 50, an upper substrate 70 which is adhered to the lower substrate 50 with a predetermined spaced between the lower substrate 50 and the upper substrate 70, and a liquid crystal layer 80 which is formed by injecting liquid crystal into the space between the lower substrate 50 and upper substrate 70.

The fabrication process of the TFT of a general LCD device will be described in detail with reference to the cross-sectional view of FIG. 1B.

Firstly, a gate electrode 10 is formed by depositing metal, for example, Mo, Al, Cr and the like on a glass substrate 1 of the lower substrate 50 using a sputtering method and by patterning the deposited metal with a first mask.

A gate insulation layer 30 is formed on the glass substrate 1 in which the gate electrode 10 is formed, by depositing an insulation material such as SiNx and the like over the entire resultant structure.

On the gate insulation layer 30, a semiconductor layer 32 which is made of amorphous silicon and an ohmic contact layer 34 which is made of $n^+$ amorphous silicon doped with high concentration phosphorous (P) are deposited and then an active layer 36 of the TFT is formed by patterning the layers 32 and 34 with a second mask.

A source electrode 8 and a drain electrode 12 of the TFT are formed by depositing a metal on the gate insulation layer 30 and the ohmic contact layer 34 and patterning the metal with a third mask. At this time, the ohmic contact layer 34 which is exposed between the source electrode 8 and the drain electrode 12 is removed in the patterning process.

A passivation layer 38 of SiNx material is deposited on the entire gate insulation layer 30 in which the source electrode 8 and the drain electrode 12 are formed including the exposed semiconductor layer 32, by a chemical vapor deposition (CVD) method. At this time, as the material for the passivation layer 38, inorganic materials such as SiNx and the like are used and recently, organic materials having a low dielectric constant, such as benzocyclobutene (BCB), spin on glass (SOG), acryl and the like are used to improve an aperture ratio of liquid crystal cells.

A drain contact hole 16 which exposes parts of the drain electrode 12 is formed by selectively etching a part of the passivation layer 38 on the drain electrode 12 using a fourth mask.

Then, transparent electrode materials are sputtered and deposited on the passivation layer 38 and a pixel electrode 14 is formed by patterning the deposited materials with a fifth mask. The pixel electrode 14 is patterned to be connected to the drain electrode 12 through the drain contact hole 16.

On the other hand, FIG. 1C is a cross-sectional view showing a storage capacitor 18 region taken along section line II-II' of FIG. 1A. The fabrication method of the storage capacitor 18 of a general LCD device will be described with reference to FIG. 1C.

Firstly, a gate line 4 is patterned on the glass substrate 1 of the lower substrate 50 and a gate insulation layer 30 is formed on the upper portion of the gate line 4. At this time, the gate line 4 is patterned simultaneously as the gate electrode 10 of the TFT is formed, and a part of a region of the gate line 4 which is overlapped with the storage electrode 20 which will be described below becomes a lower electrode of the storage capacitor 18.

The storage electrode 20 is patterned on the upper portion of the gate insulation layer 30. At this time, the storage electrode 20 is simultaneously patterned as the source and drain electrodes 8 and 12 of the TFT are formed so that the storage electrode 20 is overlapped with a part of a region of the upper gate line 4 having the gate insulation layer 30 therebetween.

After forming a passivation layer 38 on the upper portion of the gate insulation layer 30 in which the storage electrode 20 is formed, a storage contact hole 22 is formed by etching a part of the passivation layer 38 which is formed on the upper portion of the storage electrode 20. At this time, the passivation layer 38 for the storage capacitor is formed at the same time as the passivation layer 38 of the TFT region is formed, and the storage contact hole 22 is formed at the same time when the drain contact hole 16 of the TFT is formed.

By patterning a pixel electrode 14 on the passivation layer 38, the pixel electrode 14 is connected with the storage electrode 20 through the storage contact hole 22. At this time, the pixel electrode 14 is formed simultaneously as the pixel electrode 14 in the TFT region is patterned.

Finally, as described above, after forming a lower orientation layer 51 on the surface of the lower substrate in which the TFT region and storage capacitor 18 region are formed, the fabrication of the lower substrate 50 is completed by performing rubbing.

On the other hand, in the fabrication process of the upper substrate 70, a black matrix 72 is spread on a glass substrate 71 at regular intervals. Then, a color filter 73 of R, G and B colors is formed on the upper portion of the glass substrate 71 on which the black matrix 72 is separately spread so that the color filter 73 is expanded to a predetermined region of the upper portion of the black matrix 72.

Then, metal materials as a common electrode 74 are formed on the surface of the color filter 73 which includes the black matrix 72. Then, after forming an upper orientation layer 75 on the surface of the resultant material, the fabrication of the upper substrate 70 is completed by performing rubbing.

When the fabrication of the lower and upper substrates 50 and 70 is completed, a sealing member 60 is printed on the lower substrate 50 and spacer (not shown) is distributed on the upper substrate 70. At this time, the sealing member 60 is printed on the upper substrate 70 and the spacer can be distributed on the lower substrate 50 by taking the requisites for process into consideration.

When printing of the sealing member 60 and distribution of the spacer are completed, the lower substrate 50 and the upper substrate 70 are joined together. At this time, alignment for attaching the lower substrate 50 and the upper substrate 70 to each other is determined by a margin given in the designing process of the lower substrate 50 and the upper substrate 70. Conventionally, precision of several μm is required and when the actual rate is diverged from the required rate, light is leaked and accordingly, preferred picture characteristics cannot be expected. A care is taken so that the upper and lower substrates 70 are attached together such that the lower and upper orientation layers 51 and 75 which are the highest layers of the lower substrate 50 and the upper substrate 70 are regularly separated facing each other.

Then the attached lower substrate 50 and upper substrate 70 are cut into unit LCD panels. At this time, in the LCD device, since yield can be increased by forming a plurality of LCD panels on a glass substrate of a large area, the process of cutting the layers into unit LCD panels is performed. Conventionally, the cutting processing includes a scribe process of forming a cutting line on the surface of the substrate with a pen of diamond material having a higher hardness than the glass substrate and a break process of cutting by applying a mechanical force.

Thereafter, by injecting liquid crystal into each cut unit panel and sealing the injection port, a liquid crystal layer 80 is formed in the space between the lower and upper orientation layers 51 and 75 of the lower substrate 50 and the upper substrate 70. In accordance with one fabrication method of the LCD device, liquid crystal is injected into a plurality of LCD panels and then the panel is cut into unit panels. But as the size of the unit panel is increased, a method of injecting liquid crystal after cutting the panel into unit panels is preferably used.

Since the unit panel has a gap of several μm in an area of several hundred $mm^2$, a vacuum injection method using a pressure difference of the inside and outside of the unit panel is most commonly used.

On the other hand, to manufacture the above LCD device, patterning of the lamination layers is performed and the patterning process includes a coating step for spreading a photoresist film on a glass substrate, an exposing step for aligning the glass substrate and photo mask and scanning light such as ultraviolet rays to a predetermined region of the photoresist film which is spread on the glass substrate and a developing step for patterning the exposed photoresist film with developing solution.

In various patterning processes of the LCD device, the exposing step is performed using an exposure such as a stepper. The stepper generally includes a light source for emitting lights such as ultraviolet rays which deform chemical components of the photoresist film, a vacuum chuck for supporting a glass substrate on which the photoresist film is spread, a photo mask which is positioned between the light source and the glass substrate, and a lens unit for transcribing light which passed the photo mask to the glass substrate.

At this time, the vacuum chuck for supporting the glass substrate sucks air into a vacuum line which is formed on the upper surface of the absorbing plate when the glass substrate is put on the absorbing plate so that the glass substrate closely adheres to the absorbing plate by the pressure difference between the atmospheric pressure and the pressure inside the absorbing plate.

FIG. 2 is an exemplary view illustrating a plane composition of the related art vacuum chuck which supports a glass substrate and which is used in patterning the LCD devices. As shown in the drawing, the vacuum chuck includes an absorbing plate 101 for absorbing a bottom surface of the glass substrate, and a plurality of vacuum lines 102 which are formed in the concave grooves on the upper surface of the absorbing plate 101.

At this time, the vacuum lines 102 include a plurality of vacuum lines 102A which are regularly separated at the center of the absorbing plate 101 and patterned only in the vertical direction so that the glass substrate of the rectangular shape can be absorbed better, and a plurality of vacuum lines 102B which surround the above vacuum lines 102A and are regularly separated and patterned in a square belt shape (vertical and horizontal extensions), having a larger interval along the edge portion of the absorbing plate 101.

The above described vacuum lines 102A and 102B are connected to a pipe (not shown) which is formed inside the absorbing plate 101 so that a glass substrate which is to be positioned on the absorbing plate 101 can be attached (i.e., sucked to abut the absorbing plate 101) due to the pressure difference from the atmospheric pressure, when air is sucked into the vacuum lines 102 and the pipe.

FIG. 3 is an exemplary view showing a state that the glass substrate is attached on the section of the absorbing plate taken along section line III-III' of FIG. 2. As shown in the drawing, when the air is sucked in through the vacuum lines 102A and 102B, the glass substrate 100 which is attached to the absorbing plate 101 cannot stand the pressure difference from the atmospheric pressure. Therefore, there occurs a problem that the glass substrate 100 is bent along the vacuum lines 102A and 102B.

That is, the deformation of the glass substrate 100 is formed along the plurality of vacuum lines 102A and 102B that are vertical and/or horizontally disposed. By the deformation of the glass substrate 100, variations in light transmission occurs and uniform exposure cannot be performed in a stepped region. Therefore, the design of the patterned lamination layer cannot be implemented.

On the other hand, in the LCD panel of the LCD device, a plurality of date lines for transmitting data signals supplied from the data driver IC to liquid crystal cells, and a plurality of gate lines for transmitting scan signals which are supplied from the gate driver IC to the liquid crystal cells, are formed in orthogonal directions. The liquid crystal cells which form pixel units in respective crossing part of the data lines and gate lines are aligned in the active matrix form, and a TFT which is used as a switching device in the respective liquid crystal cells is formed.

Therefore, in case the deformation of the glass substrate 100 is formed at areas where the data line or gate line or electrode lines of the TFT (gate electrode, source electrode or drain electrode) overlap, the difference between the electric characteristics of lines patterned by the defective exposure process and the electric characteristics of adjacent normal lines becomes larger, since the defective exposure occurs over the entire line linearly due to the characteristic of the matrix arrangement. This causes defective factors, such as spot defects in the LCD device and the like.

SUMMARY OF THE INVENTION

Therefore, an object of the present invention is to provide a structure of a vacuum chuck for absorbing a substrate, which is capable of reducing defective factors of an LCD device by improving the structure of the vacuum chuck usable in the exposure device for the LCD device.

Another object of the present invention is to provide a vacuum chuck which is usable in fabricating display devices and overcomes problems associated with the related art.

To achieve these and other advantages and in accordance with the purpose of the present invention, as embodied and broadly described herein, there is provided a structure of a vacuum chuck for absorbing a substrate in accordance with a first embodiment of the present invention, including an absorbing plate absorbing a bottom surface of a substrate, a plurality of vacuum line grooves in an oblique line shape on the absorbing plate, and a pipe connected to the plurality of vacuum lines.

To achieve these and other advantages and in accordance with the purpose of the present invention, as embodied and broadly described herein, there is provided a structure of a vacuum chuck for absorbing a substrate in accordance with a second embodiment of the present invention, including an absorbing plate absorbing a bottom surface of a substrate, a plurality of vacuum lines having grooves in a wave pattern shape, and a pipe connected to the plurality of vacuum lines.

To achieve these and other advantages and in accordance with the purpose of the present invention, as embodied and broadly described herein, there is provided a structure of a vacuum chuck for absorbing a substrate in accordance with a third embodiment of the present invention, including an absorbing plate absorbing a bottom surface of a substrate, a plurality of first vacuum lines which divide the absorbing plate into first and second regions, and in which concave grooves are formed on the upper surface of the first region of the absorbing plate in an oblique line shape, a plurality of second vacuum lines in which concave grooves are formed on the upper surface of the second region of the absorbing plate in an oblique line shape, and a pipe which is connected to the plurality of first and second vacuum lines.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

Figure 1A:
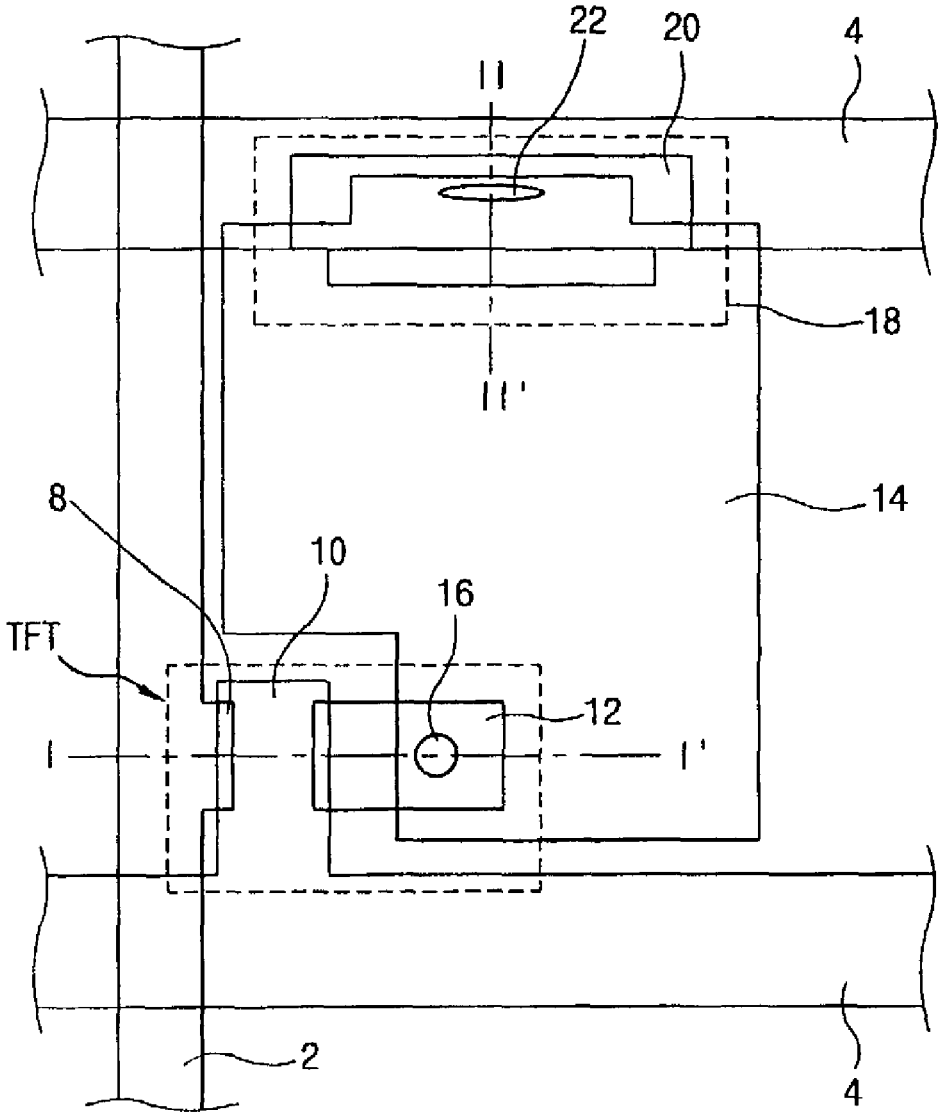
FIG. 1A RELATED ART
FIG. 1A is a plan view showing a general liquid crystal cell of an LCD device.
Figure 1B:
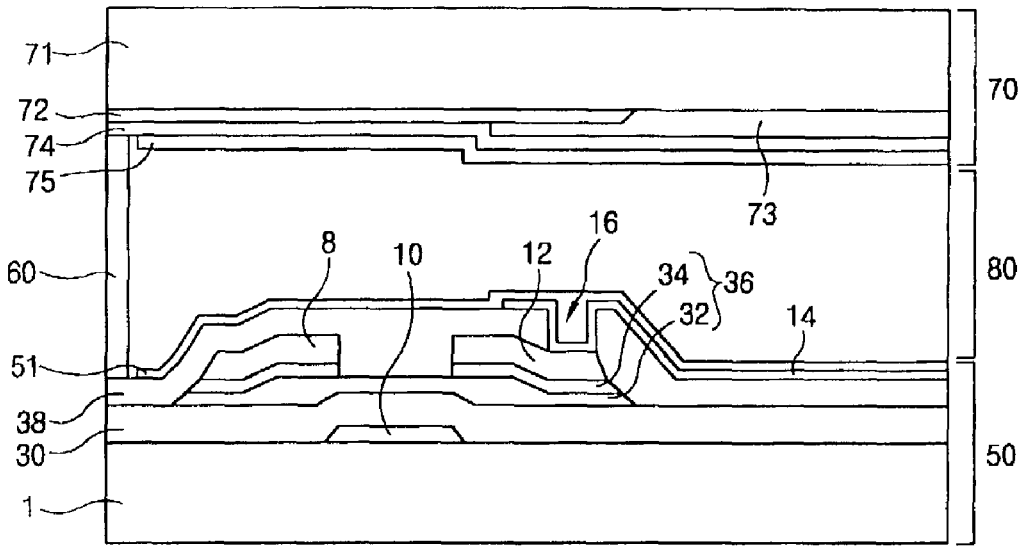
FIG. 1B RELATED ART
FIG. 1B is a cross-sectional view taken along section line I-I' of FIG. 1A.
Figure 1C:
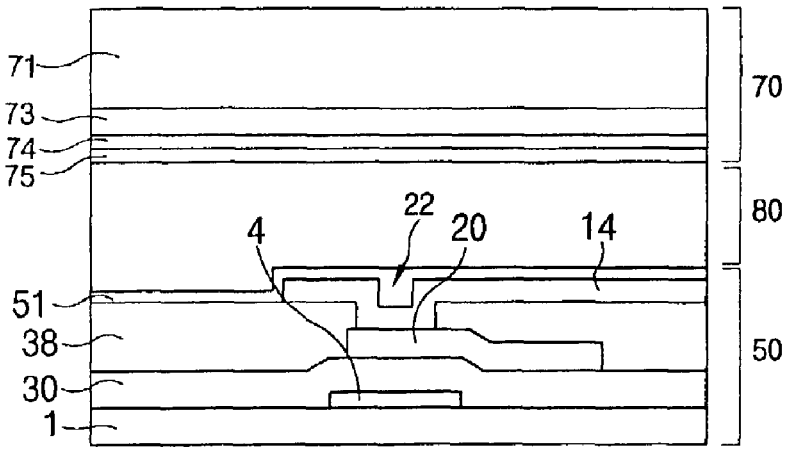
FIG. 1C RELATED ART
FIG. 1C is a cross-sectional view taken along section line II-II' of FIG. 1A.
Figure 2:
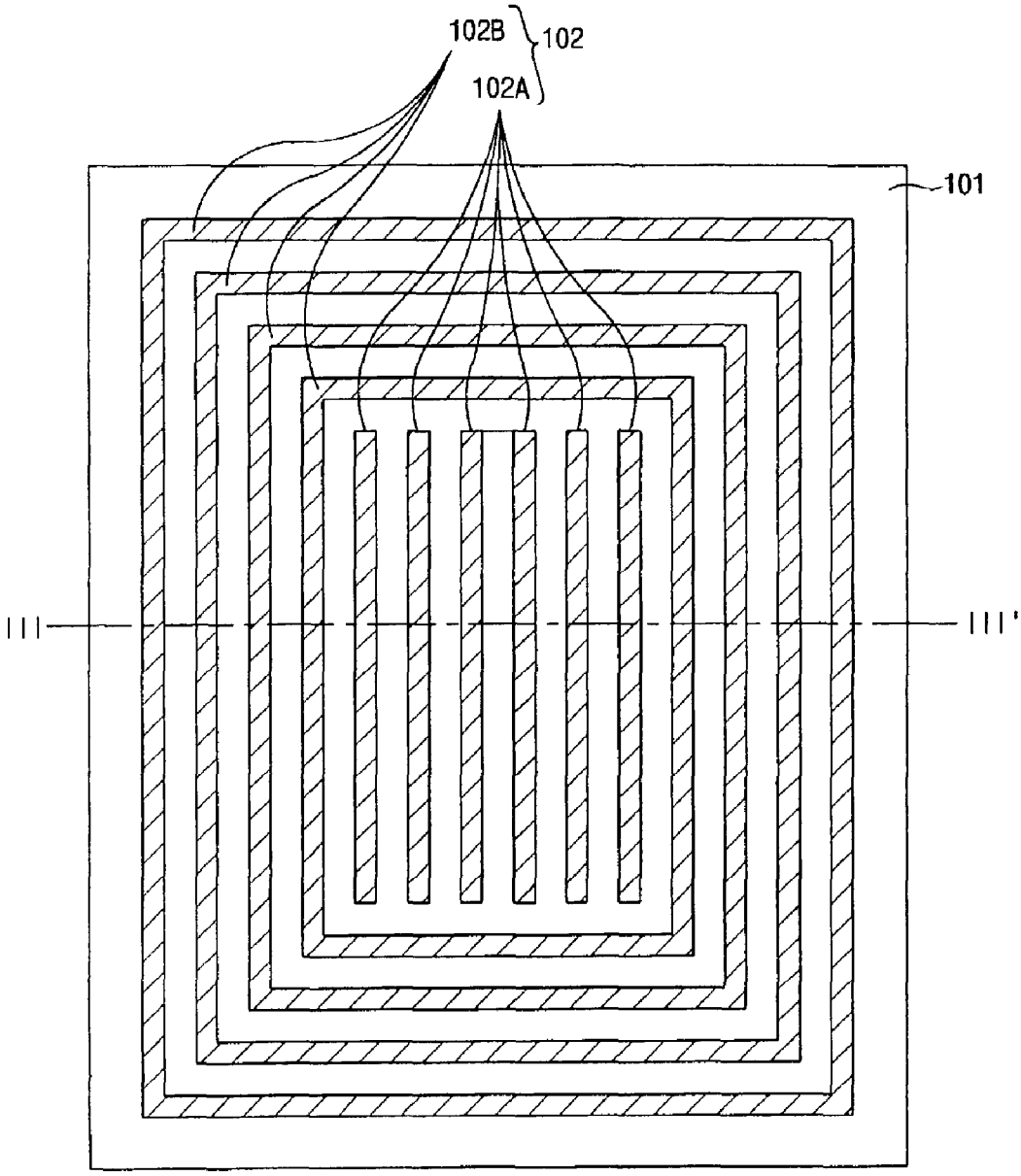
FIG. 2 RELATED ART
FIG. 2 is an exemplary view illustrating a plane composition of a related art vacuum chuck which supports a glass substrate.
Figure 3:
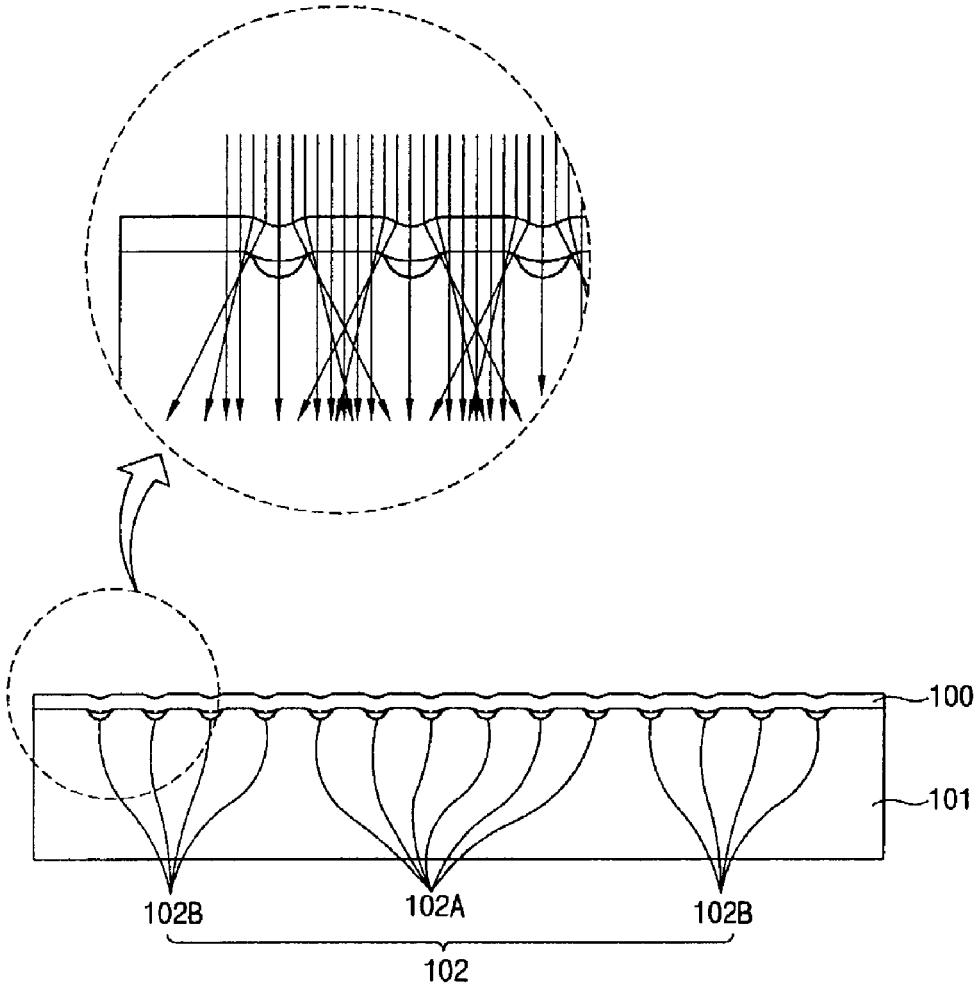
FIG.3 RELATED ART
FIG. 3 is an exemplary view showing a state that the glass substrate is attached on the section of an absorbing plate taken along section line III-III' of FIG. 2.
Figure 4:
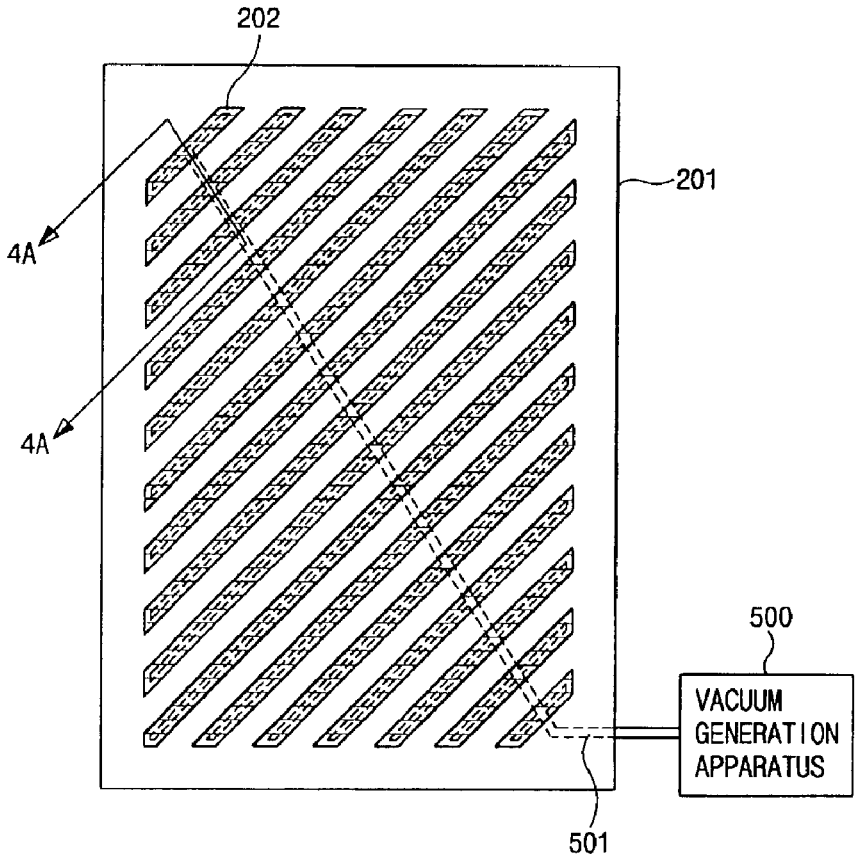
FIG. 4 is an exemplary view showing an example of a structure of a vacuum chuck for absorbing a substrate in accordance with a first embodiment of the present invention.

FIG. 4 is an exemplary view showing an example of a structure of a vacuum chuck for absorbing a substrate in accordance with a first embodiment of the present invention. As shown in the drawing, the structure of the vacuum chuck includes an absorbing plate 201 for absorbing a bottom surface of a substrate and a plurality of vacuum lines 202 formed in an oblique line shape (e.g., non-vertical and/or non-horizontal linear lines) in a first direction on the absorbing plate 201. The vacuum lines 202 in this example are concave grooves that are separated from each other at regular intervals, but may have other shapes and sizes.

A pipe 501 as known is connected to the plurality of vacuum lines 202 and formed inside the absorbing plate 201 to suck air into the vacuum lines 202 using a vacuum generation apparatus 500. Here, any known vacuum generation apparatus can be used. In one embodiment, the pipe 501 and/or vacuum generation apparatus 500 may be separately connected to the vacuum chuck or may be disposed inside or integrated with the vacuum chuck.

Figure 5:
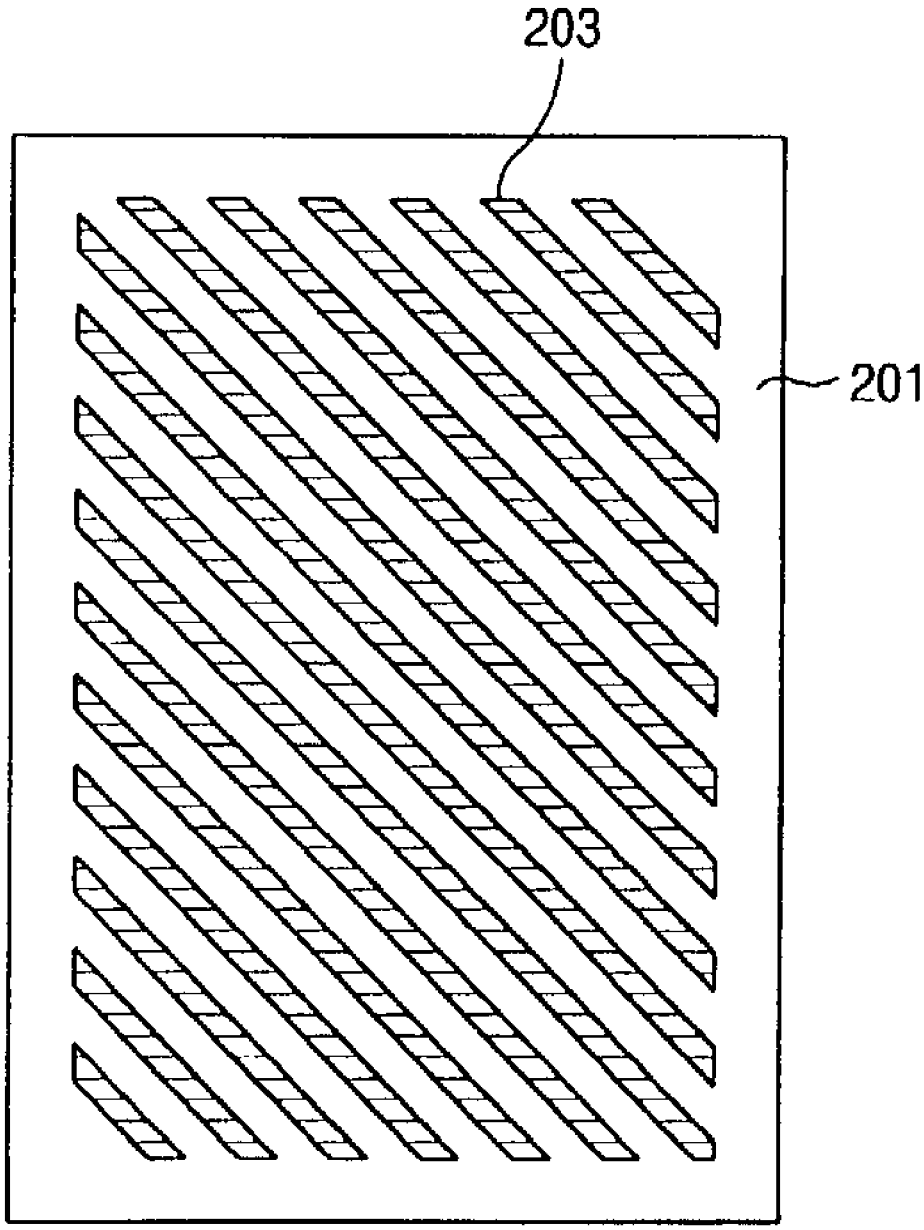
FIG. 5 is an exemplary view showing another example of a structure of a vacuum chuck for absorbing a substrate in accordance with the first embodiment of the present invention.

FIG. 5 is an exemplary view showing another example of the structure of a vacuum chuck for absorbing a substrate in accordance with the first embodiment of the present invention. As shown in the drawing, a plurality of vacuum lines 203 can be separated at regular intervals and formed in an oblique line shape in a second direction. Here, the second direction is perpendicular or substantially perpendicular to the first direction shown in FIG. 4. The pipe and the vacuum generation apparatus are also provided in FIG. 5 in the same manner as the pipe 501 and vacuum generation apparatus 500 of FIG. 4.

Figure 6:
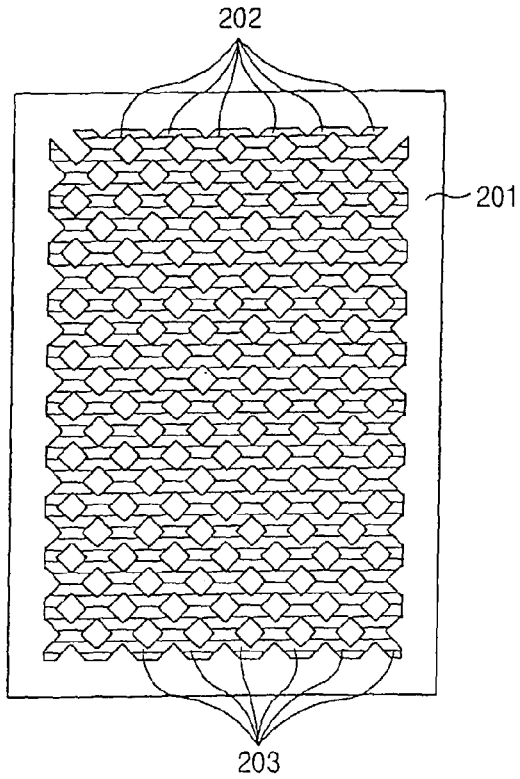
FIG. 6 is an exemplary view showing still another example of a structure of a vacuum chuck for absorbing a substrate in accordance with the first embodiment of the present invention.

FIG. 6 is an exemplary view showing still another example of the structure of the vacuum chuck for absorbing a substrate in accordance with the first embodiment of the present invention. As shown in the drawing, the plurality of first vacuum lines 202 which are separated at regular intervals and formed in the oblique line shape in the first direction as shown in FIG. 4, and the plurality of second vacuum lines 203 which are separated at regular intervals and formed in the oblique line shape in the second direction as shown in FIG. 5 are simultaneously formed to cross each other in a grid shape on the absorbing plate 201. The pipe and the vacuum generation apparatus are also provided in FIG. 6 in the same manner as the pipe 501 and vacuum generation apparatus 500 of FIG. 4.

Figure 4A:
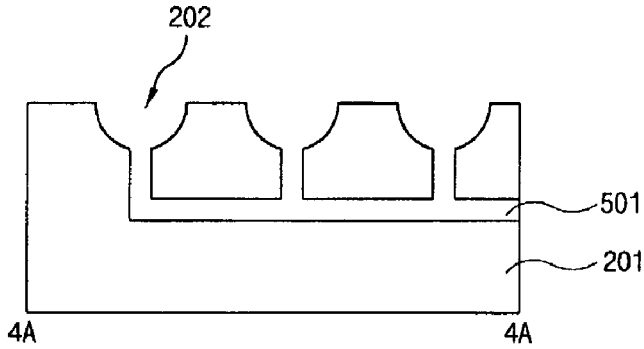
FIG. 4A is an example of a concave groove of a vacuum line, taken along line 4A-4A of FIG. 4.

The grooves of the vacuum lines 202 and 203 may have the same or similar shape as the groove shown in FIG. 4A.

Therefore, when the substrate is sucked to adhere to the absorbing plate, any deformation that may occur along the vacuum lines may now occur at oblique lines in accordance with the first embodiment. Then any exposure defect becomes uniform by the oblique line deformation on the front surface of an LCD having matrix arrangements, since the vacuum lines are formed in the oblique line shape. This prevents defective factors such as spot defects in the LCD device by minimizing electric characteristic differences between adjacent data/gate lines of the LCD device.

Figure 7:
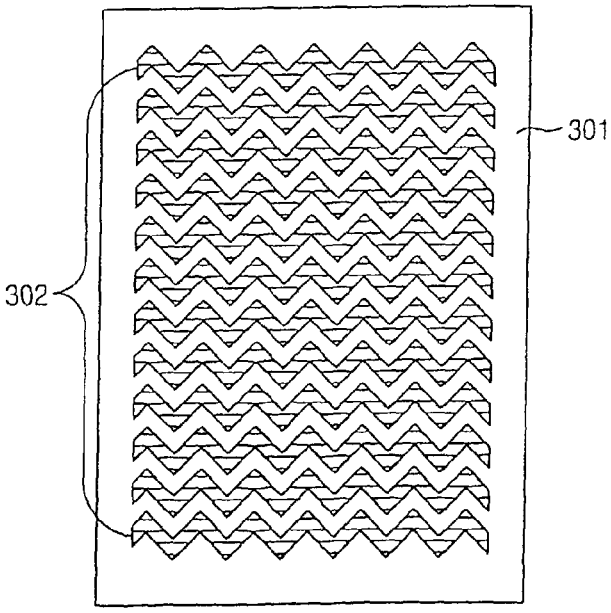
FIG. 7 is an exemplary view showing an example of a structure of a vacuum chuck for absorbing a substrate in accordance with a second embodiment of the present invention.

FIG. 7 is an exemplary view showing an example of the structure of the vacuum chuck for absorbing a substrate in accordance with a second embodiment of the present invention. As shown in the drawing, the structure of the vacuum chuck includes an absorbing plate 301 for absorbing a bottom surface of a substrate and a plurality of vacuum lines 302 formed on the upper surface of the absorbing plate 301 in a wave pattern shape in the horizontal direction. The vacuum lines 302 are concave grooves separated at regular intervals and formed in the vertical direction.

The concave grooves of the vacuum lines 302 may have the same or similar shape as the groove of the vacuum line 202 as shown in FIG. 4A. The pipe and the vacuum generation apparatus are also provided in FIG. 7 in the same manner as the pipe 501 and vacuum generation apparatus 500 of FIG. 4.

In the structure of the vacuum chuck for absorbing a substrate in accordance with the second embodiment of the present invention, any exposure defect becomes uniform on the entire surface of the LCD panel which has the matrix arrangement even if the substrate is absorbed to the absorbing plate. Further, any deformation is generated along the vacuum lines as in the first embodiment, since the vacuum lines are formed in the wave pattern shape in the horizontal direction. Therefore, electric characteristic difference among adjacent lines can be minimized thus to prevent defective factors such as spot defects in the LCD device.

Figure 8:
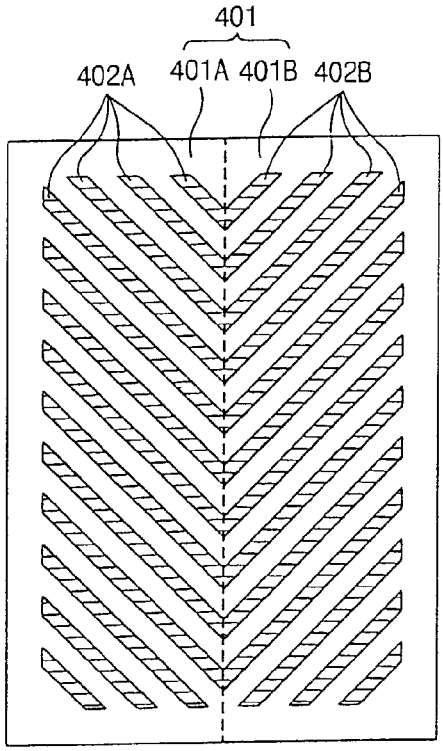
FIG. 8 is an exemplary view showing an example of a structure of a vacuum chuck for absorbing a substrate in accordance with a third embodiment of the present invention.

FIG. 8 is an exemplary view showing an example of the structure of the vacuum chuck for absorbing a substrate in accordance with a third embodiment of the present invention. As shown in the drawing, the structure of the vacuum chuck for absorbing a substrate includes an absorbing plate 401 for absorbing a bottom surface of a substrate, a plurality of first vacuum lines 402A and second vacuum lines 402B which divide the absorbing plate 401 into first and second regions 401A and 401B. The first vacuum lines 402A are concave grooves formed on the upper surface of the first region 401A of the absorbing plate 401 in an oblique line shape in a first direction, where these grooves are separated at regular intervals. The second vacuum lines 402B are concave grooves formed on the upper surface of the second region 401B of the absorbing plate 401 in an oblique line shape in a second direction, where these grooves are separated at regular intervals. The first and second directions are perpendicular to each other, but also can be at an acute or obtuse angle to each other.

The concave grooves of the vacuum lines 402A and 402B may have the same or similar shape as the groove of the vacuum line 202 shown in FIG. 4A. The pipe and the vacuum generation apparatus are also provided in FIG. 8 in the same manner as the pipe 501 and vacuum generation apparatus 500 of FIG. 4.

Figure 9A:
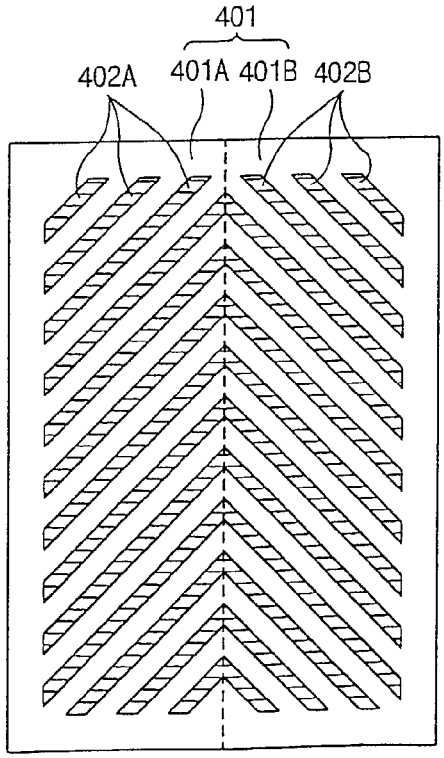
FIGS. 9A to 9C are exemplary views showing different examples of a structure of a vacuum chuck for absorbing a substrate in accordance with the third embodiment of the present invention.
Figure 9B:
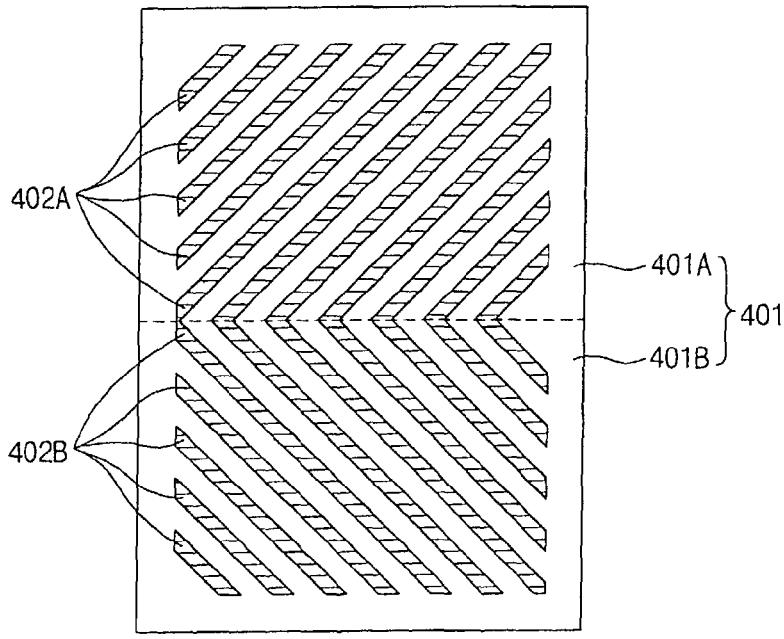
Figure 9C:
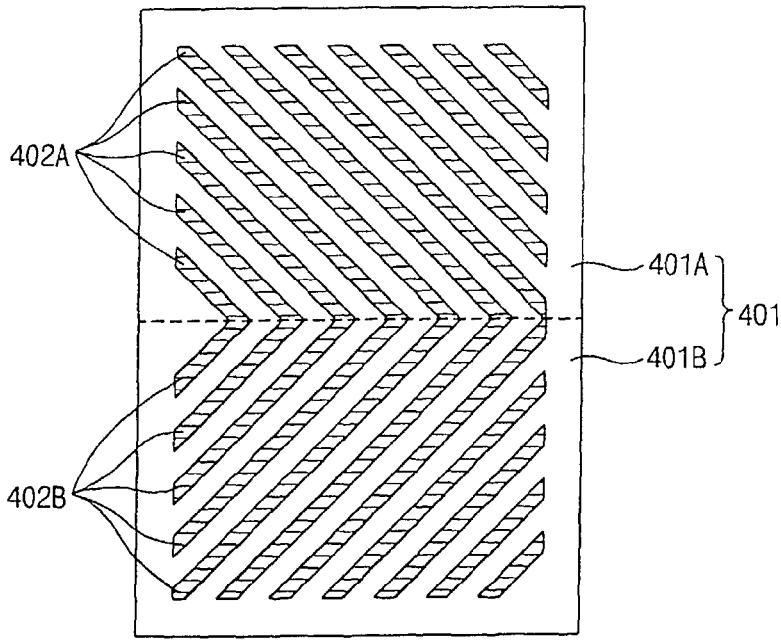

FIGS. 9A to 9C are exemplary views showing other examples of the vacuum chuck according to the third embodiment of the present invention. As shown in the drawing, the structures of FIGS. 9A-9C are variations of the structure shown in FIG. 8, by varying the directions of the vacuum lines and/or by dividing the absorbing plate 401 horizontally, rather than vertically.

The concave grooves of the vacuum lines 402A and 402B may have the same or similar shape of the groove of the vacuum line 202 shown in FIG. 4A. The pipe and the vacuum generation apparatus are also provided in FIGS. 9A-9C in the same manner as the pipe 501 and vacuum generation apparatus 500 of FIG. 4.

In the structure of the vacuum chuck for absorbing a substrate in accordance with the third embodiment of the present invention, any exposure defect becomes uniform on the entire surface of the liquid crystal panel which has the matrix arrangement even if the substrate is absorbed to the absorbing plate. Any deformation is generated along the vacuum lines as in the first embodiment, since the vacuum lines are formed in the oblique line shape. Therefore, electric characteristic differences among adjacent lines can be minimized thus to prevent defective factors such as spot defects in the LCD device.

In the structure of the vacuum chuck for absorbing a substrate in accordance with the embodiments of the present invention, even if the substrate is absorbed closely to the absorbing plate and a deformation is generated along the vacuum lines, since the vacuum lines are formed in non-vertical and/or non-horizontal lines (e.g., in the oblique line, wave pattern shape in the horizontal direction, or any combination thereof), any exposure defect becomes uniform on the entire surface of the liquid crystal panel which has the matrix arrangement. Therefore, any difference in electric characteristics of adjacent lines can be minimized thus to prevent defective factors such as spot defects of the LCD device.

The vacuum chucks according to the embodiments of the present invention can be used to pattern and form LCD devices. However, they are not limited to such, and can be used to temporarily adhere a substrate or the like to the absorbing plate for performing patterning, re-shaping, and other appropriate functions for any device, system, or method. Further, the vacuum lines can be extended in the shape and/or configuration which is a mixture or combination of any of the vacuum lines disclosed in the first to third embodiments of the invention. For example, the absorbing plate can be divided into two regions diagonally, where the first region includes the wavy vacuum lines 302 extending in a horizontal direction as shown in FIG. 7 and the second region includes wavy vacuum lines 302 extending in a vertical direction. Also, the absorbing plate can be divided into any number of regions in any direction. The separation distance between the vacuum lines in one divided region of the absorbing plate may be the same as or different from the separation distance between the vacuum lines in another divided region of the same absorbing plate. The absorbing plate can also have different shapes, such as square, oval, circular, etc.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. A vacuum chuck for absorbing a substrate, comprising:

an absorbing plate to absorb the substrate, the absorbing plate having a first region for absorbing the substrate and a second region formed in an outer portion of the first region; and a plurality of vacuum lines formed on the surface of the absorbing plate, each vacuum line being linearly formed in a line shape extended to one side from the other side of the first region of the surface of the absorbing plate corresponding to the substrate, the vacuum lines being contacted with the surface of the substrate to absorb the substrate, wherein the plurality of vacuum lines are obliquely extended to the sides of the absorbing plate and a distance between the vacuum lines is uniform in the whole area of the first region of the absorbing plate, wherein all of the vacuum lines are extended in the same direction on the surface of the absorbing plate.

2. The structure of claim 1, wherein the vacuum lines are separated at certain uniform intervals.

3. The vacuum chuck of claim 1, further comprising:

a pipe connected to the plurality of vacuum lines.

4. The vacuum chuck of claim 1, wherein the plurality of vacuum lines are configured to attach the substrate to the absorbing plate without a separate seal surrounding the plurality of vacuum lines.

5. The vacuum chuck of claim 1, wherein the plurality of vacuum lines are configured such that all vacuum lines contribute to adhering the substrate to the absorbing plate.

6. The vacuum chuck of claim 1, wherein the plurality of vacuum lines are configured such that an adhesion force is distributed throughout all regions of the surface of the absorbing plate.

7. The vacuum chuck of claim 1, further comprising a pipe formed inside the absorbing plate, wherein the pipe is connected to all of the plurality of vacuum lines.

8. The vacuum chuck of claim 7, further comprising a vacuum generation apparatus connected to the pipe to provide a vacuum force to the substrate via the pipe and the plurality of vacuum lines.

9. The vacuum chuck of claim 7, further comprising a vacuum generation apparatus connected to the pipe to provide a vacuum force to the substrate via the pipe and the plurality of vacuum lines.

10. An apparatus for absorbing a substrate having a plurality of gate lines and data lines, the apparatus comprising:

an absorbing plate to absorb the substrate, the absorbing plate having a first region for absorbing the substrate and a second region formed in an outer portion of the first region; and a plurality of vacuum lines formed on the surface of the absorbing plate, the vacuum line being continuously extended in a direction oblique to the extension direction of the data line so that the adhesion force caused by the vacuum lines is applied to the portion of the substrate formed in the direction oblique to the extension direction of the data line of the substrate.

11. The apparatus of claim 10, further comprising a pipe formed inside the absorbing plate, wherein the pipe is connected to all of the plurality of vacuum lines.

12. The apparatus of claim 11, further comprising a vacuum generation apparatus connected to the pipe to provide a vacuum force to the substrate via the pipe and the plurality of vacuum lines.

* * * * *